US008283584B2

(12) United States Patent
Wang et al.

(10) Patent No.: US 8,283,584 B2
(45) Date of Patent: Oct. 9, 2012

(54) ELECTRONIC DEVICE HAVING BUTTON CAPABLE OF PREVENTING ACCIDENTAL DEPRESSION

(75) Inventors: Kai-Gui Wang, Shenzhen (CN); Kok-Kan Chan, Santa Clara, CA (US); Hua-Lin Lv, Shenzhen (CN); Yu Zou, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 289 days.

(21) Appl. No.: 12/846,857

(22) Filed: Jul. 30, 2010

(65) Prior Publication Data

US 2011/0253518 A1 Oct. 20, 2011

(30) Foreign Application Priority Data

Apr. 14, 2010 (CN) ..... 2010 1 0146814

(51) Int. Cl.
*H01H 9/28* (2006.01)

(52) U.S. Cl. ..... 200/43.18

(58) Field of Classification Search .... 200/43.16–43.21, 200/318, 318.2, 321, 327, 341
See application file for complete search history.

(56) References Cited

U.S. PATENT DOCUMENTS 3,629,529 A * 12/1971 Dietz ..... 200/43.19
3,906,814 A * 9/1975 Magnussen ..... 200/43.18
6,844,512 B2 * 1/2005 Benda ..... 200/43.14
7,232,970 B1 * 6/2007 Chen ..... 200/332.2

* cited by examiner

*Primary Examiner* — Felix O Figueroa
(74) *Attorney, Agent, or Firm* — Altis Law Group, Inc.

(57) ABSTRACT

An electronic device includes a housing and a button. The housing defines a through hole. The sidewall of the through hole defines a pair of positioning holes. The button includes a frame, a sliding bar assembly, an elastic conductive member, and a pressing member. The sliding bar assembly is received in the frame with two external ends respectively received in the positioning holes to cause the frame to be received in the through hole. The elastic conductive member is fixed in the housing. The pressing member hooks the frame and extends through the frame to resist the sliding bar assembly. When the pressing member is depressed, the pressing member resists the sliding bar assembly to cause the external ends to move out of the positioning holes. Further depress on the pressing member causes the frame to press the elastic conductive member to actuate the button.

9 Claims, 7 Drawing Sheets

ELECTRONIC DEVICE HAVING BUTTON CAPABLE OF PREVENTING ACCIDENTAL DEPRESSION

BACKGROUND

1. Technical Field

The present disclosure relates to electronic devices and, particularly, to an electronic device with a button capable of preventing from being accidentally depressed.

2. Description of Related Art

Usually, buttons of electronic devices, for example, power buttons of desk computers, can be actuated by a gentle press, which may result in accidental activation or deactivation. For example, when a file is being edited using a desktop computer, if the power button is accidentally depressed, the computer may be suddenly shut down, which may cause loss of edits made to the file.

BRIEF DESCRIPTION OF THE DRAWINGS

The components of the drawings are not necessarily drawn to scale, the emphasis instead being placed upon clearly illustrating the principles of an electronic device having a button capable of preventing accidental depression. Moreover, in the drawings, like reference numerals designate corresponding parts throughout several views.

DETAILED DESCRIPTION

Figure 1:
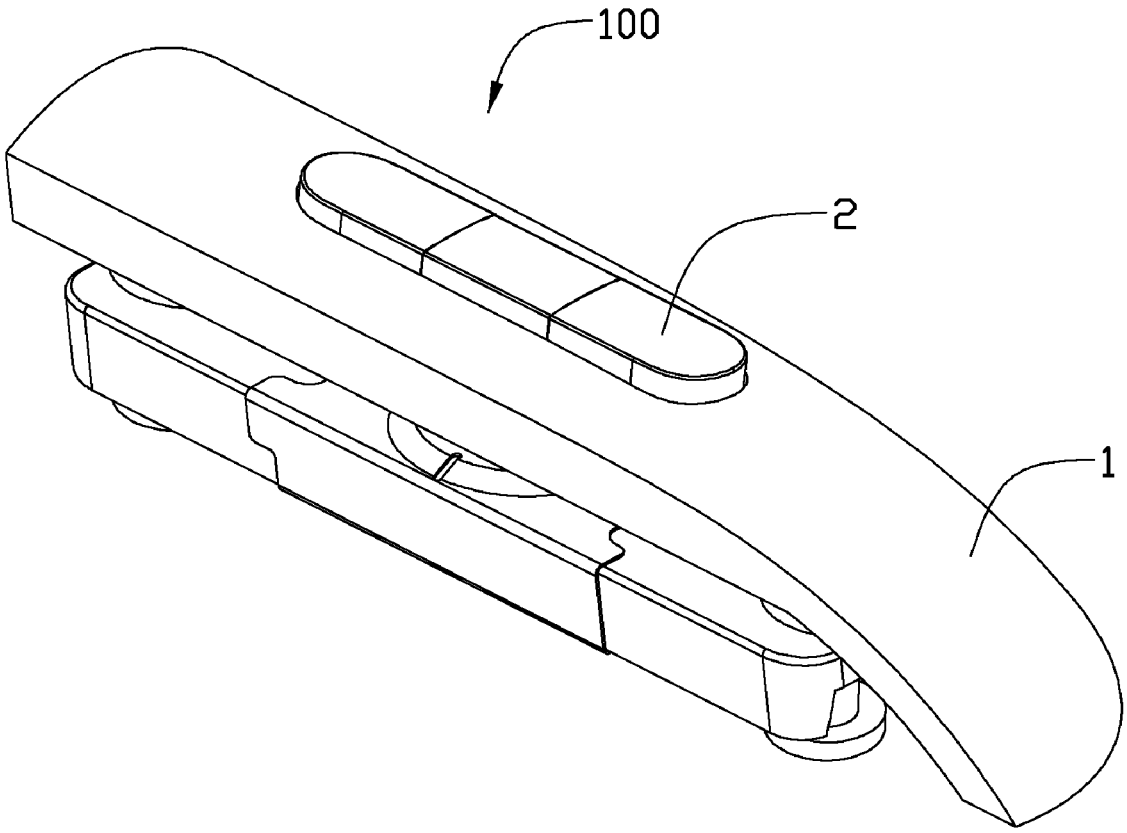
FIG. 1 is a partial, isometric view of an electronic device in accordance with an exemplary embodiment.

Referring to FIG. 1, an electronic device 100 includes a housing 1 and a button 2 mounted in the housing 1.

Figure 2:
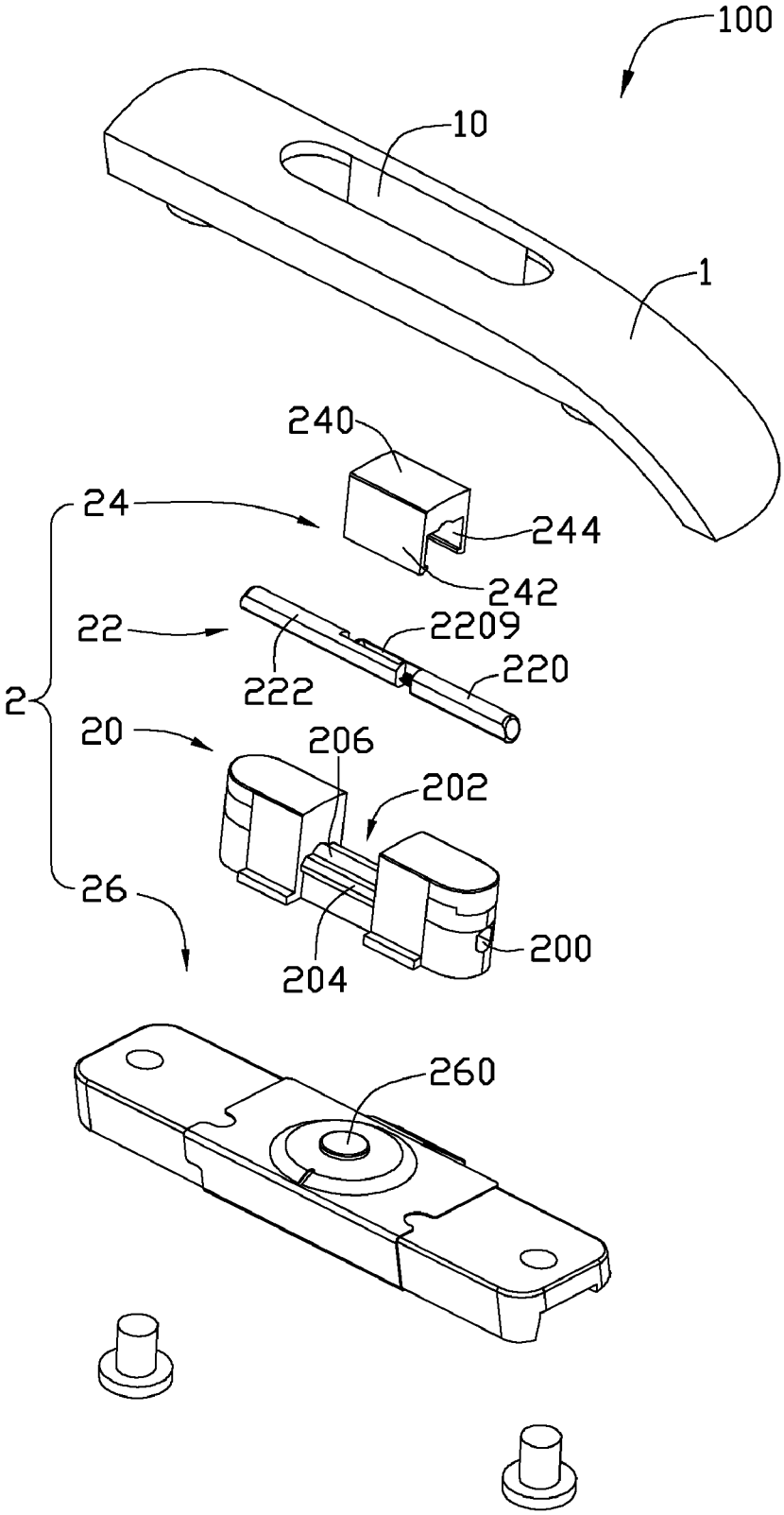
FIG. 2 is an exploded, perspective view of the electronic device of FIG. 1.
Figure 3:
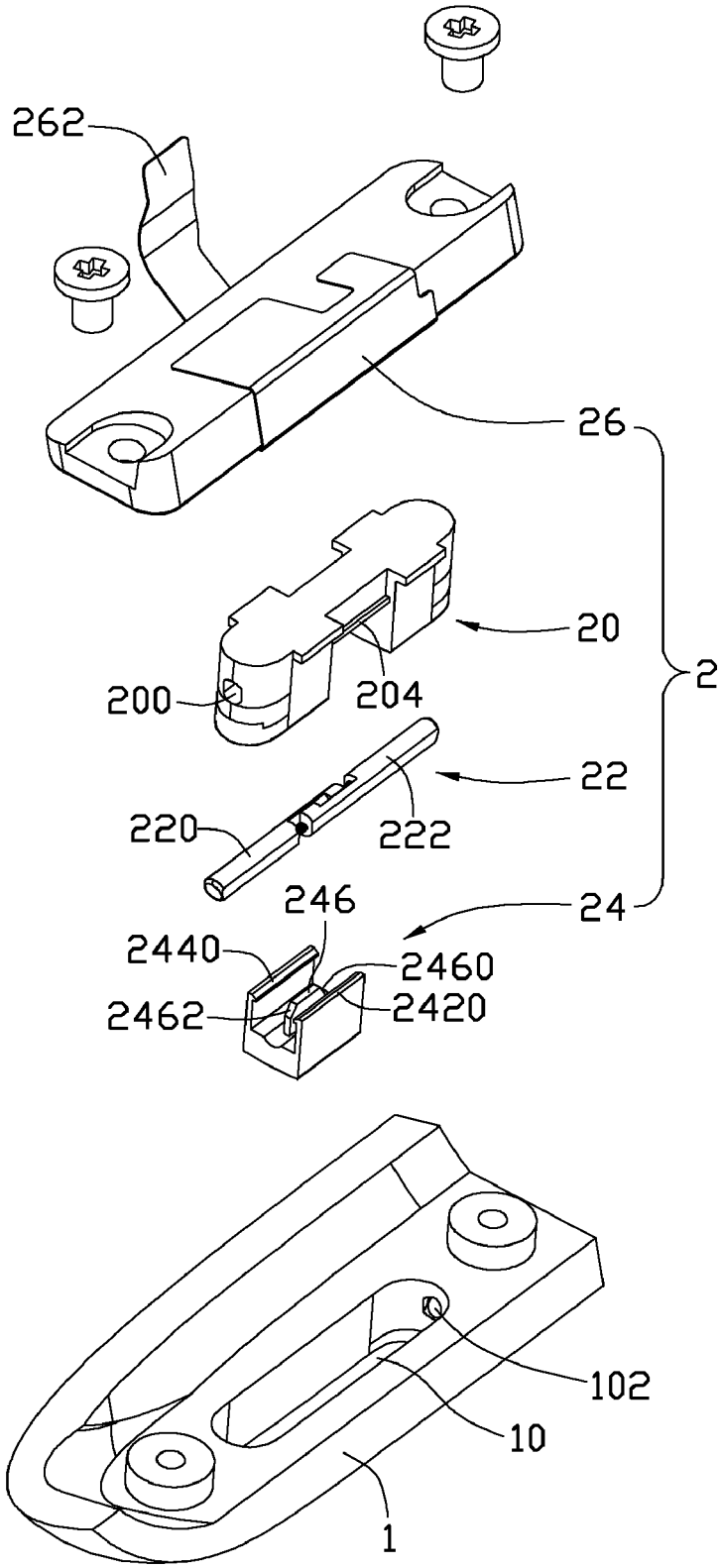
FIG. 3 is another exploded, perspective view of the electronic device of FIG. 1, from another viewpoint.

Referring also to FIGS. 2-3, the housing 1 defines a through hole 10 to partially receive the button 2. The sidewall of the through hole 10 defines a pair of opposite positioning holes 102.

The button 2 includes a frame 20, a sliding bar assembly 22, a pressing member 24, and an elastic conductive member 26. The sliding bar assembly 22 extends through the frame 20 with two ends external to the frame 20, and the external ends are respectively received in the positioning holes 102 to cause the frame 20 to be received in the through hole 10. The pressing member 24 movably hooks the frame 20 and is operable via the through hole 10. A portion of the pressing member 24 passes through the frame 20 and resists the sliding bar assembly 22. The elastic conductive member 26 is fixed in the housing 1 and faces the frame 20. If the pressing member 24 is depressed, the pressing member 24 pushes the sliding bar assembly 22 to cause the ends of the sliding bar assembly 22 to slide out of the positioning holes 102. At this point, further pressing the pressing member 24 causes the frame 20 to depress the elastic conductive member 26. Pressing the elastic conductive member 26 causes the elastic conductive member 26 to be electrically connected to a circuit board (not shown) of the electronic device 100, thus actuating the button 2. If the pressing member 24 is released, the elastic conductive member 26 rebounds to cause the frame 20, the sliding bar assembly 22, and the pressing member 24 to return their original states.

The frame 20 defines a receiving hole 200 extending through two opposite ends of the frame 20 to receive the sliding bar assembly 22. The frame 20 defines an opening 202 extending downward from the top of the frame 20. A pair of latching protrusions 204 protrudes from the bottom of the opening 202. The bottom of the opening 202 further defines a slot 206 communicating with the receiving hole 200 and arranged between the latching protrusions 204.

Figure 4:
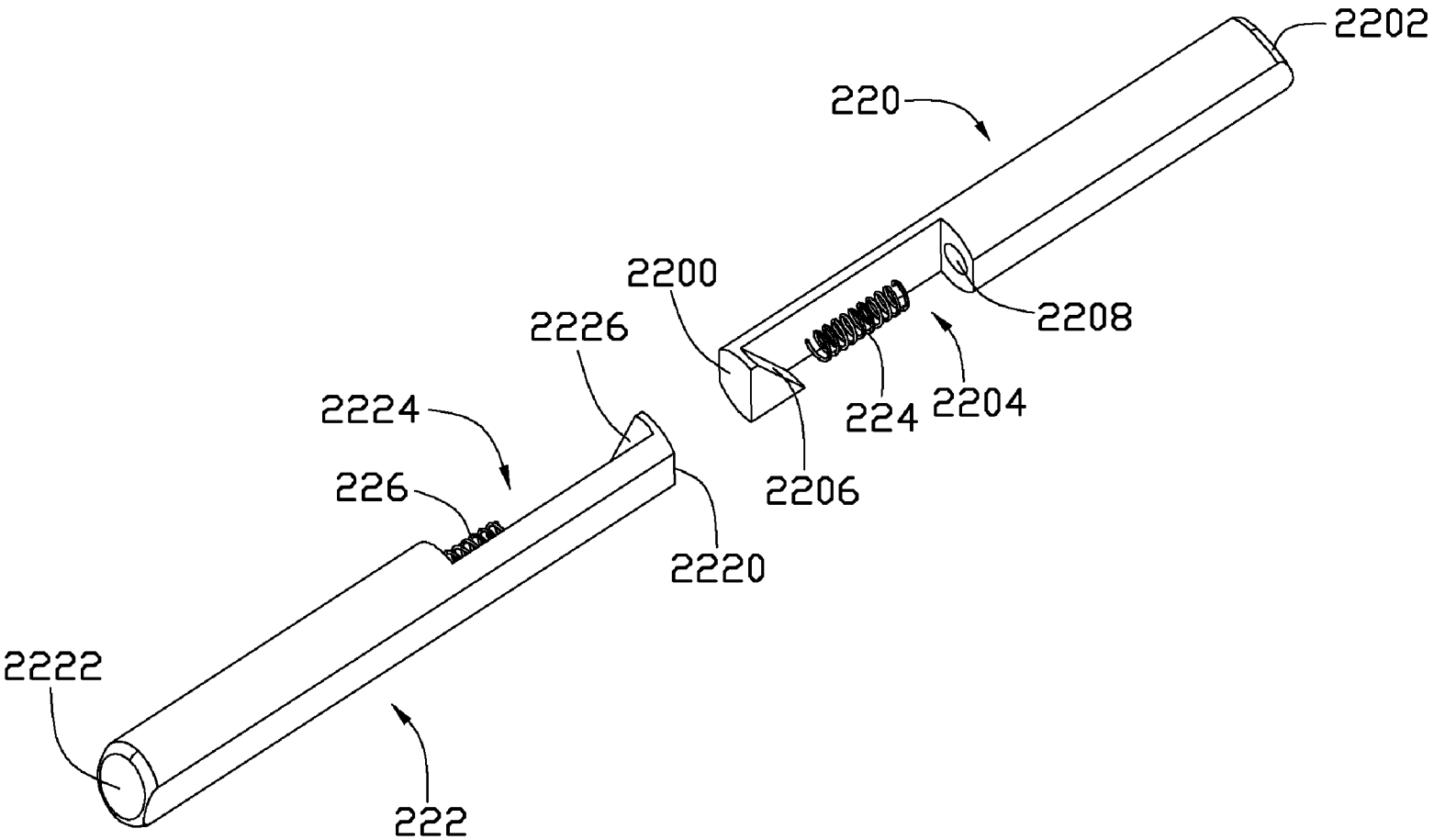
FIG. 4 is an exploded, perspective of a sliding bar assembly of a button of the electronic device of FIG. 1.
Figure 5:
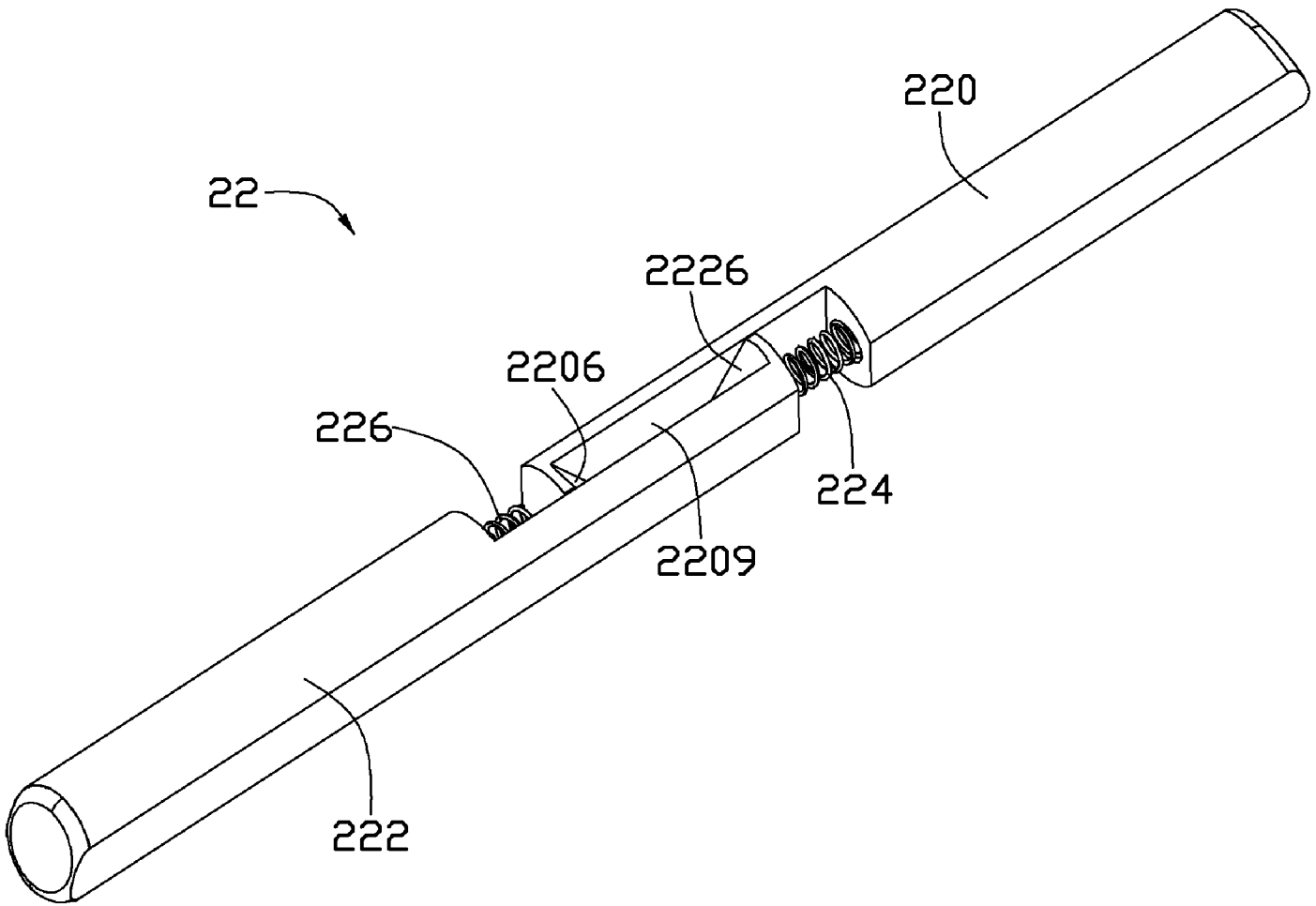
FIG. 5 is an isometric view of the sliding bar assembly of the button of the electronic device of FIG. 1

Referring also to FIGS. 4-5, the sliding bar assembly 22 includes a first sliding bar 220, a second sliding bar 222, a first elastic member 224, and a second elastic member 226. In this embodiment, the first elastic member 224 and the second elastic member 226 are coil springs.

The first sliding bar 220 includes two opposite ends 2200 and 2202. The end 2202 is external to the receiving hole 200 and received in one of the positioning holes 102. The first sliding bar 220 defines a first cavity 2204 adjacent to the end 2200. The first cavity 2204 includes a first inclined surface 2206. A side of the first cavity 2204 opposite to the first inclined surface 2206 defines a first blind hole 2208. One end of the first elastic member 224 is received in the first blind hole 2208. The structure of the second sliding bar 222 is the same as the first sliding bar 220. The second sliding bar 222 includes two opposite ends 2220 and 2222. The end 2222 is external to the receiving hole 200 and received in the other positioning hole 102. The second sliding bar 222 defines a second cavity 2224. The second cavity 2224 includes a second inclined surface 2226 and a second blind hole 2228 (see FIG. 6). One end of the second elastic member 226 is received in the second blind hole 2228. In the sliding bar assembly 22, the end 2200 and the first inclined surface 2206 are received in the second cavity 2224, and the end 2220 and the second inclined surface 2226 are received in the first cavity 2204. The other end of the first elastic member 224 resists the end 2220, and the other end of the second elastic member 226 resists the end 2200. Therefore, the first sliding bar 220 and the second sliding bar 222 cooperatively form a receiving space 2209. The receiving space 2209 includes a larger opening (not labeled) and a smaller opening (not shown). The larger opening faces the slot 206.

The pressing member 24 includes a pressing plate 240, a first sidewall 242, and a second sidewall 244. The first sidewall 242 and the second sidewall 244 are perpendicular to the pressing plate 240 and parallel to each other. The free end of the first sidewall 242 defines a first hook 2420, and the free end of the second sidewall 244 defines a second hook 2440 opposite to the first hook 2420. The first hook 2420 and the second hook 2440 respectively hook the latching protrusions 204. A pressing projection 246 protrudes from the bottom of the pressing plate 240 and is arranged between the first sidewall 242 and the second sidewall 244. The pressing projection 246 passes through the slot 206 to be partially received in the receiving space 2209. The pressing projection 246 includes a third inclined surface 2460 and a fourth inclined surface 2462. The third inclined surface 2460 is inclined opposite to the first inclined surface 2206, so that they can match up with and resist each other. The fourth inclined surface 2462 is inclined opposite to the second inclined surface 2226, so that they can match up with and resist each other.

The elastic conductive member 26 includes a protruding portion 260 and an elastic portion 262. The protruding portion 260 faces the frame 20. When the protruding portion 260 is depressed by the frame 20, the elastic portion 262 is electrically connected to the circuit board of the electronic device 100.

Figure 6:
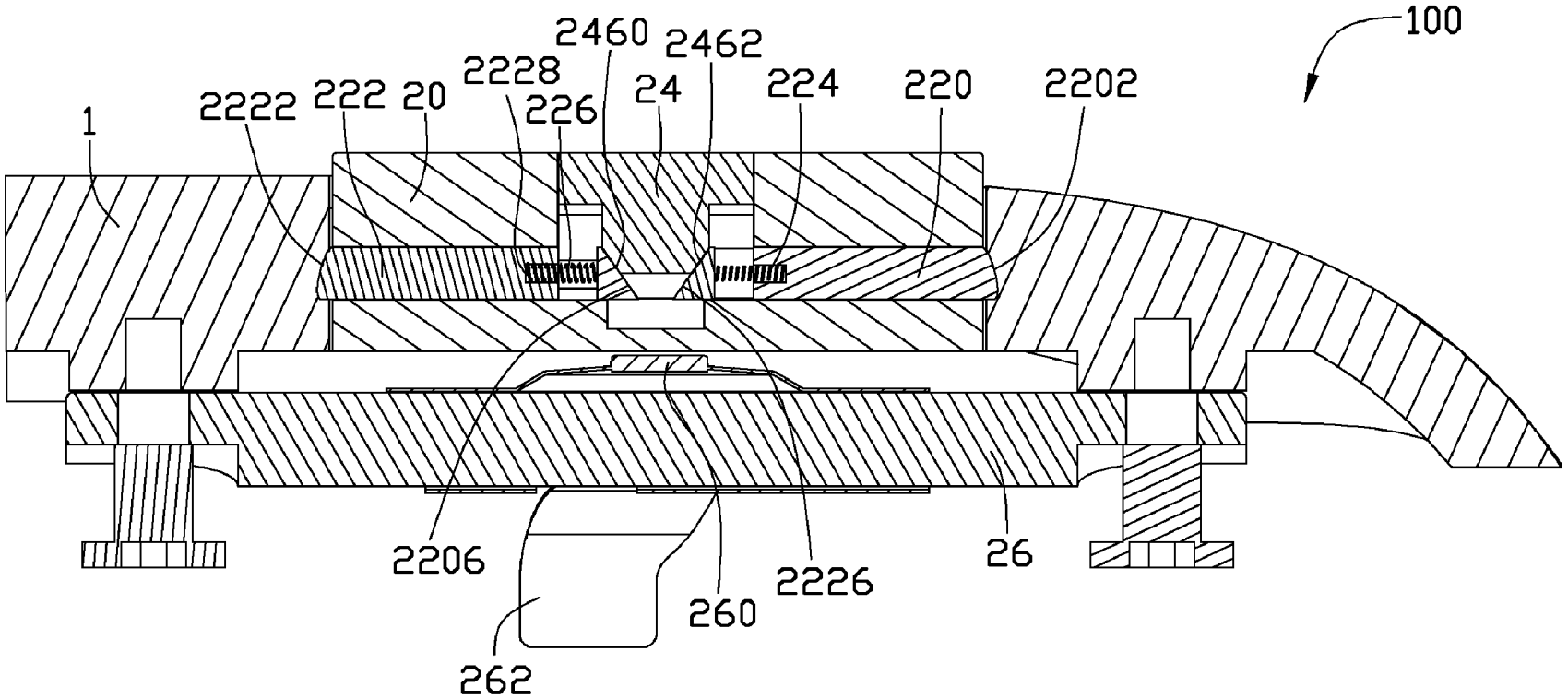
FIG. 6 is a cross-sectional view of the electronic device of FIG. 1, showing the electronic device in a first state.
Figure 7:
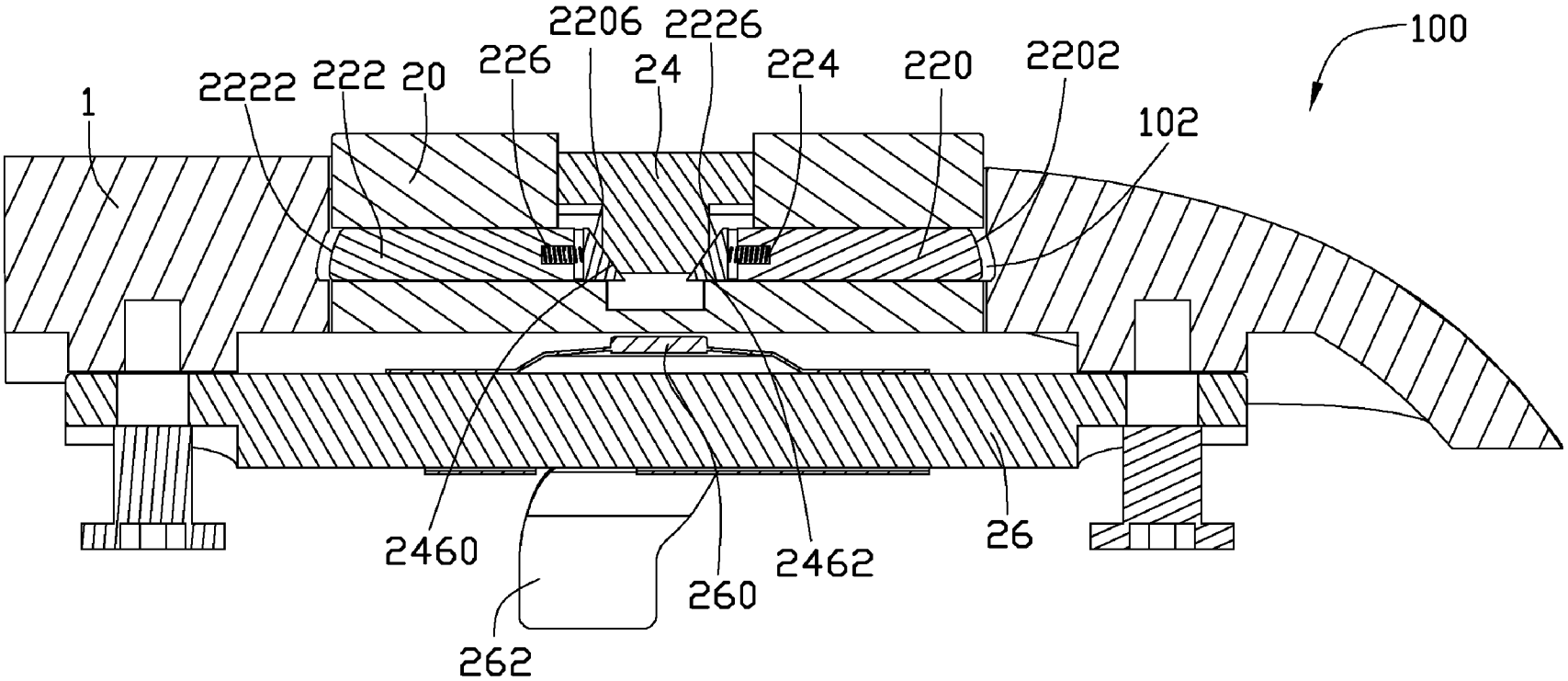
FIG. 7 is similar to FIG. 6, but showing the electronic device in a second state.

Referring also to FIGS. 6-7, to actuate the button 2, the pressing member 24 is depressed to cause the third inclined surface 2460 and the fourth inclined surface 2462 to respectively push the first inclined surface 2206 and the second inclined surface 2226, thus compressing the first elastic member 224 and the second elastic member 226. As the first elastic member 224 and the second elastic member 226 are compressed to a certain extent, the ends 2202 and 2222 respectively move out of the positioning holes 102. At this point, the frame 20 and the sliding bar assembly 22 move along with the pressing member 24, and further pressing the pressing member 24 causes the frame 20 to depress the protruding portion 260 until the elastic portion 262 is electrically connected to the circuit board of the electronic device 100. At this point, the button 2 is actuated. The pressing member 24 is then released, and the elastic portion 262 rebounds to cause the frame 20 to move away from the protruding portion 260. As the frame 20 is moved to a position where the ends 2202 and 2222 are respectively aligned with the positioning holes 102, the first elastic member 224 and the second elastic member 226 rebound to cause the ends 2202 and 2222 to be respectively received in the positioning holes 102. At this point, the button 2 returns to its original state.

With such configuration, gently pressing the button 2 cannot cause the frame 20 to press the elastic conductive member 26, that is, gently pressing the button 2 cannot actuate the button 2, thus avoiding accidental operations of the electronic device 100.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electronic device, comprising:

a housing defining a through hole, wherein the through hole comprising a sidewall defining a pair of positioning holes; and a button comprising:

a frame received in the through hole and defining a receiving hole through the frame;

a sliding bar assembly received in the receiving hole and comprising a first sliding bar, a second sliding bar, a first elastic member, and a second elastic member, wherein one end of the first elastic member is received in the first sliding bar, and an opposite end of the first elastic member resists one end of the second sliding bar, one end of the second elastic member is received in the second sliding bar, and an opposite end of the second elastic member resists one end of the first sliding bar, an opposite end of the first sliding bar and an opposite end of the second sliding bar are external to the receiving hole and respectively received in the positioning holes;

an elastic conductive member fixed in the housing and facing the frame; and a pressing member moveably hooking the frame and comprising a projection, wherein the projection passes through the frame and resists the first sliding bar and the second sliding bar, when the pressing member is depressed by an external force, the projection pushes the first sliding bar and the second sliding bar to compress the first elastic member and the second elastic member and cause the opposite end of the first sliding bar and the opposite end of the second sliding bar to move out of the positioning holes, further pressing the pressing member causes the frame to move until the frame presses the elastic conductive member to actuate the button.

2. The electronic device as described in claim 1, wherein the sliding bar assembly further comprises a receiving space formed by the first sliding bar and the second sliding bar, the receiving space is bounded a pair of opposite first inclined surfaces formed on the first sliding bar and the second sliding bar, respectively, the projection comprises a pair of opposite second inclined surfaces, the second inclined surfaces respectively resist the first inclined surfaces.

3. The electronic device as described in claim 2, wherein the receiving space is arranged between the first elastic member and the second elastic member.

4. The electronic device as described in claim 2, wherein the frame defines an opening, a bottom of the opening defines a slot communicating with the receiving hole, the pressing member is received in the opening, the projection passes through the slot to be received in the receiving space.

5. The electronic device as described in claim 4, wherein the pressing member comprises a pressing plate operable via the through hole, the projection protrudes from the pressing plate.

6. The electronic device as described in claim 5, wherein the pressing member further comprises two sidewalls parallel to each other and perpendicular to the pressing plate, each of the sidewalls defines a hook, the bottom of the opening comprises a pair of latching protrusions, each of the hooks hooks one of the latching protrusions.

7. The electronic device as described in claim 6, wherein the projection is arranged between the sidewalls, and the slot is arranged between the latching protrusions.

8. The electronic device as described in claim 1, wherein the elastic conductive member comprises a protruding portion facing the frame and an elastic portion, when the protruding portion is depressed by the frame, the elastic portion causes the button to be actuated.

9. An electronic device, comprising:

a housing defining a through hole, a sidewall of the through hole defining a pair of positioning holes; and a button comprising:

a frame received in the through hole and defining a receiving hole through the frame;

a sliding bar assembly received in the receiving hole and comprising a first sliding bar, a second sliding bar, a first elastic member, a second elastic member, and a receiving space, wherein the receiving space is arranged between the first elastic member and the second elastic member, one end of the first elastic member is received in the first sliding bar, and an opposite end of the first elastic member resists one end of the second sliding bar, one end of the second elastic member is received in the second sliding bar, and an opposite end of the second elastic member resists one end of the first sliding bar, an opposite end of the first sliding bar and an opposite end of the second sliding bar are external to the receiving hole and respectively received in the positioning holes;

an elastic conductive member fixed in the housing and facing the frame; and a pressing member moveably hooking the frame and comprising a projection, wherein the projection passes through the frame to be received in the receiving space and to resist the first sliding bar and the second sliding bar, when the pressing member is depressed by an external force, the projection pushes the first sliding bar and the second sliding bar to compress the first elastic member and the second elastic member and cause the opposite end of the first sliding bar and the opposite end of the second sliding bar to move out of the positioning holes, further depressing the pressing member causes the frame to move until the frame depresses the elastic conductive member to actuate the button.

* * * * *